United States Patent [19]

Diakantonis et al.

[11] 4,027,304

[45] May 31, 1977

[54] ALARM AND SAFETY CAPSULE

[76] Inventors: Tony Diakantonis, Woodcrest Gardens D-12, Mahopac, N.Y. 10541; Warren L. Sweatt, 19 Covington Road, Yonkers, N.Y. 10701

[22] Filed: Apr. 19, 1976

[21] Appl. No.: 678,060

[52] U.S. Cl. ..... 340/304; 340/272; 340/274 R

[51] Int. Cl.[2] ..... G08B 21/00

[58] Field of Search ..... 340/304, 272, 274

[56] References Cited

UNITED STATES PATENTS

| | | | |
|---|---|---|---|
| 790,822 | 5/1905 | Gale | 340/304 X |
| 3,886,537 | 5/1975 | Mann | 340/304 R |
| 3,964,057 | 6/1976 | Wells | 340/304 |

*Primary Examiner*—Harold Pitts
*Attorney, Agent, or Firm*—Daniel M. Rosen

[57] ABSTRACT

An alarm and a safety capsule includes a booth having a door. A control circuit for the booth includes a switch, for sending an alarm, which is not operative until the booth door is closed, and inhibits closing of the door if attempts are made to operate the button with the door open. A timing circuit responsive to operation of the button prohibits release of the door for a determined period. A further button, energized by the timing circuit, enables an occupant of the booth to unlock the door. The door may also be unlocked by a radio control circuit.

10 Claims, 4 Drawing Figures

ALARM AND SAFETY CAPSULE

THE INVENTION

This invention relates to alarm and safety capsules, and more in particular to such devices of the type having a door which is maintained closed for a determined period following the sending of an alarm.

Alarm booths of the above type are well known, and are disclosed, for example, in U.S. Pat. No. 3,886,537. Such booths are intended to overcome the problem of false alarms sent to a Fire Department, by holding the person giving an alarm in the booth for a determined period, or until the Fire Department arrives at the scene. In prior systems of the type, the booth is generally unlocked automatically after a given time, so that the occupant, who has given an alarm, is automatically released.

The present invention is directed to the provision of improvements in such booths, whereby the giving of false signals is further inhibited, and the booth may also be employed as a safety capsule, whereby a person escaping from an assailant may enter a booth and lock the door by depressing a call signal for a Police Department. If a Police Department does not arrive by the end of the timing cycle of the booth, in accordance with the invention the door is not automatically unlocked, but instead a release circuit is energized so that the occupant himself may unlock the door, if the danger has passed.

Briefly stated, in accordance with the invention, the controls operated by the occupant of the booth are merely push button spring return switches. The alarm push buttons are not energized to start a control sequence until the door is closed, and solenoids or the like are provided to inhibit closing of the door if the buttons are pushed while the door is open. This inhibits attempts to defeat the function of the alarm booth by jamming the alarm buttons in closed position.

Upon closing of the door, the alarm buttons are energized, whereby they may be depressed to energize relays which effect the locking of the door in a closed position by a locking solenoid, and the completion of a communication line through the fire or police station. In addition, a timing circuit is energized. After a determined period, the timer applies an operating potential to an "open door" button, but the locking solenoid is not released until operation of the open door button. The open door button, upon depression, effects the release of the locking solenoid as well as the de-energization of the remainder of the circuit to effect the resetting of a circuit.

In addition, the circuit may be de-energized by external radio control, which also effects the de-energization of the circuits of the system. This enables unlocking of the door by Police or Fire personnel when they arrive on the scene.

The alarm booth may also be provided with suitable local alarms, such as a beacon or a siren, which are also operated in response to proper depression of an alarm button.

In order that the invention will be more clearly understood, it will now be disclosed in greater detail with reference to the accompanying drawings, wherein.

Figure 1:
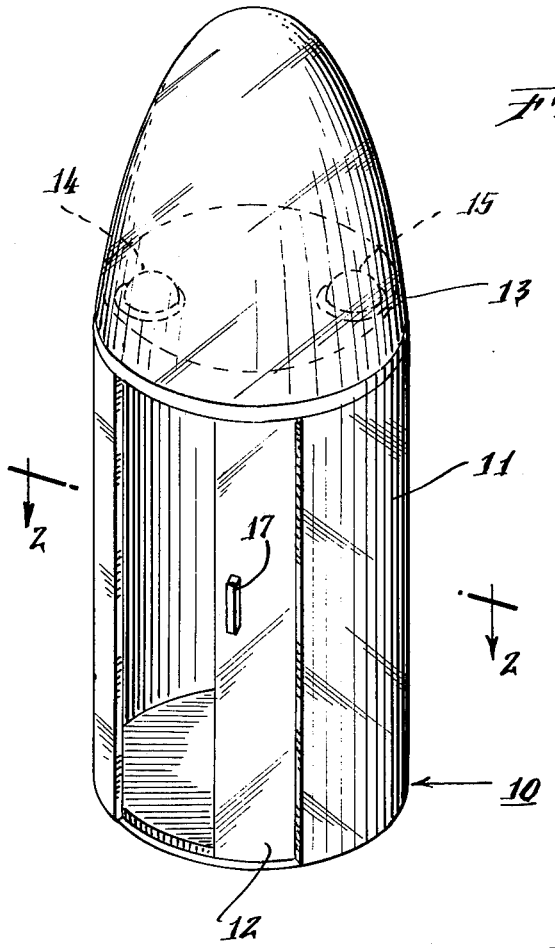
FIG. 1 is a perspective view of an alarm and a safety capsule in accordance with the invention.
Figure 2:
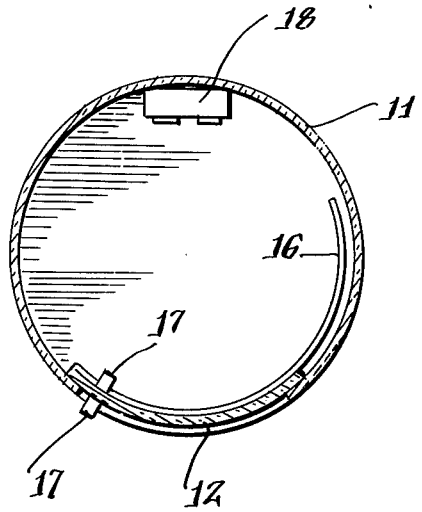
FIG. 2 is a cross-sectional view of the capsule of FIG. 1, taken along the lines of II—II.

Referring now to the drawings, FIG. 1 illustrates a capsule 10 having sides 11, a door 12, and a preferably removable top 13. The sides 11 and the door 12 may for a circular configuration, and are made of a strong material, such as clear Lexan, so that an occupant inside the booth would be safe from attack by an assailant. The top 13 of the capsule is preferably conical, and is also of a strong material such as clear Lexan. An alarm beacon 14 and/or an alarm siren 15 may be provided in the top of the booth. The beacon will thus be visible through the top 13. Slots (not shown) may be provided in the top 13 for the alarm siren. As shown in FIG. 2, the door 12 is slidable in tracks 16 so that the door may be opened or closed. The door 12 also has handles 17 on the inside and outside thereof. A control box 18 extends downwardly into the booth from the top 13, and is positioned so that it may be operated by an occupant of the booth. All of the control circuitry for the capsule is provided sealed in the top 13, and since the control box 18 descends from the top 13, the entire control mechanism for the capsule may be removed for repair or replacement. Of course, a suitable connectional means, such as screws (not shown) or the like, may be provided for holding the top 13 on the booth. Such clamping of the top should of course be designed to inhibit tampering, and suitable locks (not shown) may be provided for this purpose, although this is not the subject of the present invention.

Figure 3:
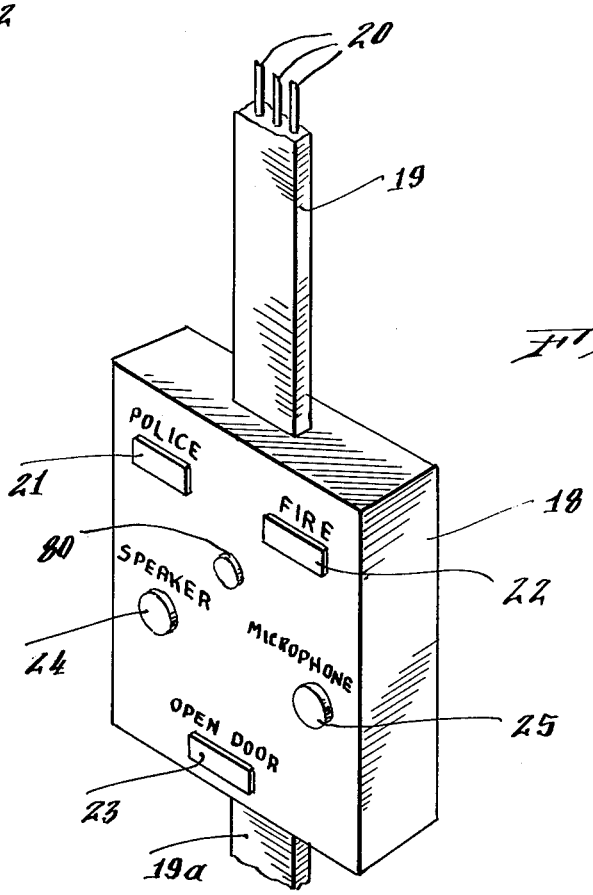
FIG. 3 is a perspective illustration of the control units that may be employed in the capsule of FIG. 1.

An example of the control box 18 is illustrated in FIG. 3. The control box 18 is connected to the top 13 by a suitable hollow conduit 19 enclosing conductors 20 extending between the control box and the remainder of the circuit in the top 13. AC supply for the circuit, as well as other external connections such as the police and fire lines, extend through the bottom of the capsule to the box 18 by way of conduit 19*a*. The conduit 19 extends the AC line to the control unit in the top 13, as well as other control leads. The conduit 19 may have connections (not shown) enabling the disconnection of the control circuits when the top 13 is removed from the capsule. In a typical application, the control box 18 will have three buttons, i.e., a police button 21, a fire button 22, and an open door button 23. These buttons may be comprised of spring return push buttons switches. No further controls are necessary. In addition, the control box 18 may have a speaker 23 for receiving communications from the Fire or Police Department, and a microphone 25 to enable the occupant of the booth to inform a Police Department or Fire Department of the reason for the alarm.

Figure 4:
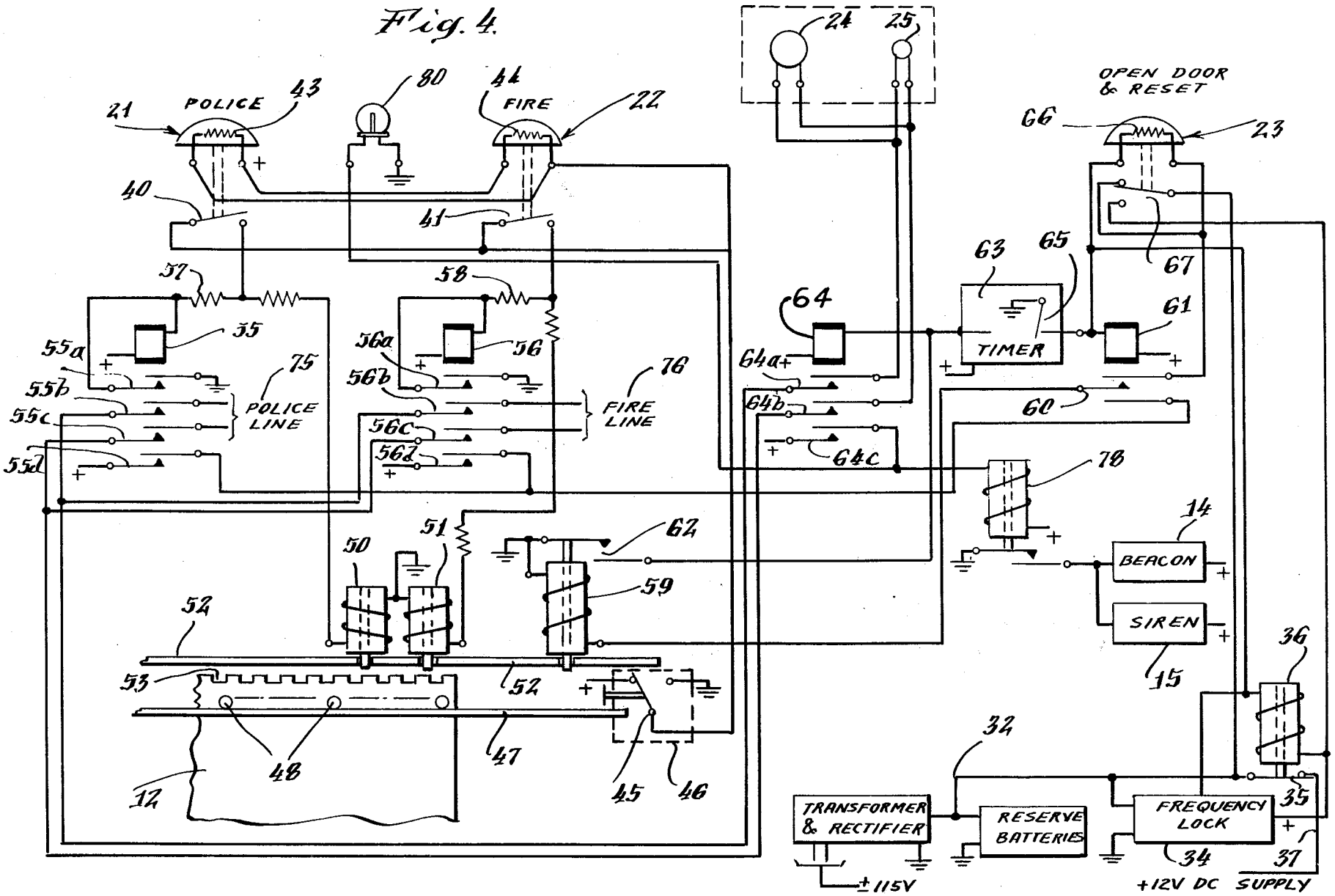
FIG. 4 is a circuit diagram of a control circuit, in accordance with the invention, that may be employed in the capsule of FIG. 1.

Referring now to FIG. 4, the circuit may be energized from the 115 volt AC mains applied to the terminals 30 and connected to a conventional transformer and rectifier circuit for producing a 12 volt DC output on line 32. A battery 33 is connected between the line 32 and ground reference, so that a battery may be charged by the main's voltage, and will serve as an emergency supply in the event of loss of the main's voltage. The power for the majority of the circuits of the control circuit is derived from the line circuit 32 by way of a frequency lock circuit 34 and the contacts 35 of a relay 38. This portion of the circuit will be disclosed in greater detail in the following paragraphs, and for the moment it can be assumed that the plus terminal 37 is directly connected to the line 32 for energization of the system. It is of course immaterial whether the voltage at the terminal 37 is positive or negative, and the plus sign has been employed merely for the sake of convenience. The remainder of the terminals marked plus in the circuit are of course connected to the terminal 37.

The push buttons 21 and 22 are mechanically coupled to operate switches 40 and 41 respectively. These push buttons may contain suitable lamps 43 and 44 respectively, one terminal of each of which is connected to the positive supply. The other terminal of each lamp 43, 44 is connected to the arm 45 of a limit switch 46 positioned to be activated by the door 12 in closed position. For example, the door may roll on upper tracks 47, by means of rollers 48, so that it contacts the arm 45 of the switch 46 only in the closed position thereof. In the open or partially open position of the door, the switch arm 45 is connected to the positive supply, while in the closed position of the door, the arm 45 is connected to ground. As a result, the lamps 43 and 44 are not energized in the open position of the door, since the positive supply is connected to both terminals thereof. In the closed position of the door, the lamps are energized by the switch 46, to indicate that the push buttons 21 and 22 are energized and can be operated.

The other terminals of the switches 40 and 41 are connected, for example, by way of limiting resistors, to solenoids 50 and 51 respectively. The other terminals of these solenoids are grounded. The armatures of these solenoids extend through a plate 52 in the top of the booth, to engage recesses 53 in the top of the door 12 aligned therewith. Thus, if a push button 21 or 22 is pushed in the open position of the door, a switch 46 applies positive potential by way of the switches 40 and 41 to the solenoids 50 and 51, so that these solenoids may be energized to move their armatures in position to lock the door against it for their movement. Upon release of the push buttons 21 and 22, the solenoids are also released. When the door 12 is in closed position, however, these solenoids are not activated, since at this time depression of the push buttons 21 and 22 will connect ground to both ends of the solenoids It is thus apparent that depression of the push buttons 21 and 22 when the door is in open or partially open position, will result in locking of the door, so that it cannot be moved further. This feature serves to inhibit tampering of the system. As a result, if attempts are made to tamper with the system, for example be wedging the push buttons 21 or 22, the door 12 will be locked in position, and hence cannot be closed to enable the sending of an alarm.

The switches 40 and 41 are also connected to energize the coils of relays 55 and 56 respectively. The other ends of these coils are connected to the positive source. When the door 12 is in the open position, if the buttons 21 or 22 are depressed, positive potential will be applied to the relays 55 and 56, and hence these relays will not operate. On the other hand, when the door 12 is closed and the push buttons 21 or 22 are depressed, ground will be connected to the coils of these relays, for example, by way of series resistors 57 and 58 respectively, to energize these relays. In this case, the contacts **55*a* and 56*a* of these relays connect the relay coils to ground, so that the relays are latched in energized position when the buttons 21 or 22** are released.

A locking solenoid 59 has one terminal grounded, and the other terminal connected to positive supply by way of the closed change-over contacts 60 of a transfer relay 61, and either the contacts **55*d* of the relay 55, or the contacts 56*d* of the relay 56. The armature of the solenoid 59 also extends through the partition 52, to engage the recesses 53 in the top of the door, thereby firmly latching the door 12** in closed position.

Upon energization, the solenoid 59 closes its contact 62, to ground one terminal of the timer 63, and one end of the coil of a relay 64. The other ends of each of these devices is connected to the positive source, so that the relay 64 and the timer 63 are now energized. The timer may be set to any desired time delay, for example any time from about five to fifteen minutes, and to close its contacts 65 at the end of that determined period. It will be noted that the timer 63 is of conventional nature, and may be reset by removal of operating potential therefrom, whereby the contacts 65 only close at the end of the determined period. When the timer closes its contacts 65 a determined period following the depression of one of the push buttons 21 or 22, ground is applied to the coil of the transfer relay 61, and to one terminal of a lamp 66 in the open door and reset push button 23. This will result in the energization of the transfer relay 61, to change its transfer contacts 60. The energization of the transfer relay 61 does not result in the immediate release of the locking solenoid 59, however, since the now connected contact of the change-over contacts is connected by way of the switch 67 to the positive potential at line 32. A switch 67 is mechanically coupled to the push button 23. Since the other terminal of the lamp 66 in the open door and reset push button 23 is also connected to the now closed contacts of the switch 67, the lamp 66 will light upon completion of the timing cycle of the timer 63. This indicates to the occupant of the booth that, if desired, he may push the open door and reset push button 23 to effect the unlocking of the door of the booth.

Upon depression of the push button 23, the contacts of the switch 67 are changed, so that potential is no longer applied to the lamp 66, or to the change-over contacts 60. As a result, the lamp 66 will go out, and the solenoid 59 will be released, so that the door 12 of the booth may now be opened.

The push button 23 also resets the circuit, by momentarily removing the positive supply from the terminal 37. For this purpose, the coil of the relay 36 is connected to the normally open contacts of the switches 67. The closing of the switch 67 by depression of the push button 23 connects the continually active line 32 to the relay 36, thereby opening the contacts 35. As a result, the relays 55 and 56 will be released, the timer 63 will be reset, and the remainder of the circuits except for the relay 36 and frequency lock circuit 34 will be de-energized.

It is therefore apparent that the occupant of the booth has the option of unlocking the door once the timer 63 has energized the push button 23 and relay 61. If danger still exists, the occupant is not obliged to unlock the door by depression of the button 23, so that he may remain in safety in the booth as long as desired.

For distinctiveness, and to aid in the operation of the booth, the lights in the push buttons may have any desired colors.

The circuit may be reset, and the door unlocked, independently of the timer 63, by operation of the frequency lock circuit 34. This circuit may comprise a radio receiver adapted to receive coded radio signals, for example, from police or fire personnel in the vicinity of the booth. For example, if the police or fire personnel arrive at the scene of the booth before the predetermined timing period of the timer 63, they may actuate coded transmitters that they carry to signal a frequency lock circuit 34 to energize the relay 36 by connecting line 32 to one terminal of solenoid 36 and grounding the other terminal of this solenoid. This may be effected in conventional manner in the frequency lock, for example, by using a two pole relay. This of course results in the removal of the positive supply from the terminal 37 and hence the resetting of the relays 55 and 56, the release of the solenoid, the resetting of the timer 63, etc.

In order to enable communication between the booth and the police station or fire station, the police station may be connected to the police lines 75, and the fire station may be connected to the lines 76. These lines are connected to a microphone 25 and a speaker 24, by way of contacts **64*a* and 64*b* of the relay 64, and either the contacts 55*b* and 55*c* of the relay 55, or the contact 56*b* and 56*c* of the relay 56. Upon the actuation of the circuit by pushing of one of the buttons 21 or 22, and the following locking of the door in closed position, the closing of the contacts of the relay 64** thereby enable communication between the occupant of the booth and either police or fire station.

Further contacts **64*c* of the relay 64 may energize a heavy duty relay 78 to energize optionally the beacon 14 and siren 15,** which, as discussed above, may be located on the booth itself.

The capsule in accordance with the invention thereby provides a secure and reliable enclosure which may be employed by an individual or individuals to transmit an alarm to a police station upon the threat of violence, and to protect the individual from an assailant. In addition, the capsule inhibits the sending of false alarms, since an individual is held in the booth for a period estimated to be long enough for the Fire Department to arrive. If the alarm has been a false alarm, the occupant of the booth may easily be apprehended, since he cannot escape from the booth before the end of the timing cycle of the booth.

The booth is provided with an automatic signaling system, which automatically sends an alarm and the desired information of the location of the energized booth to the police or fire stations.

The fact that the transmission has been sent is indicated to the occupant of the booth, by the provision of a light 80, such as a green light, also provided in the booth and activated by the contacts **64*c* of a relay 64. This light 15 may also be provided on the control box 18 of FIG. 3.**

While the foregoing description has referred to one form of mechanical lock for the door 12, it will be apparent that other conventional locking mechanisms may alternatively be employed.

While the invention has been disclosed and described with reference to a limited number of environments, it will be apparent that variations and modifications can be made therein, and it is intended in the following claims to cover each such variation and modification as follows withing the true spirit and scope of the claims.

What is claimed is:

1. An alarm and safety booth having a door and a control circuit comprising manually controllable alarm switch means including a first push button, door switch means positioned to energize said alarm switch means only in the closed position of said door, means coupled to said alarm switch means for inhibiting closing of said door when said first push button is depressed, means responsive to actuation of said alarm switch means when energized for locking said door, door opening switch means including a second push button, time delay means coupled to said door locking means for energizing said door opening switch a predetermined time after said door is locked, and means responsive to operation of said door opening switch means by depression of said second push button for unlocking said door and resetting said control circuit.

2. The alarm and safety booth of claim 1 wherein said door switch means comprises means applying a first potential to said alarm switch means when said door is not closed and means applying a second potential different from said first potential to said alarm switch means when said door is closed, said means inhibiting closing of said door comprising first solenoid means responsive to said first potential and positioned to block said door, said means responsive to actuation of said alarm switch means comprising second solenoid means, and first relay means connected to said alarm switch means and responsive to said second potential for energizing said solenoid means to block said door.

3. The alarm and safety booth of claim 2, wherein said first relay means has a holding contact, and said means responsive to activation of said alarm switch means further comprises second relay means having change-over contacts connected to energize said second solenoid means in response to actuation of said first relay means, said second relay means being connected to be energized by said time delay means, said door opening switch means being connected to said change-over contacts whereby said second solenoid means remains energized upon energization of said second relay means until said second push button is depressed.

4. The alarm and safety booth of claim 3 comprising means responsive to the operation of said door opening switch means, after energization by said time delay means, for de-energizing said first and second relay means.

5. The alarm and safety booth of claim 3 further comprising receiver means for receiving signals transmitted externally of said booth, said receiver means being connected to the energizers of said first and second relay means.

6. The alarm and safety booth of claim 2, wherein said first push button comprises a source of illumination, and means connecting said source to be energized only in response to the application of said second potential to said alarm switch means.

7. The alarm and safety booth of claim 1, wherein said second push button comprises a source of illumination, and means connecting said source to be energized only when said door opening switch means is energized by said time delay means.

8. The alarm and safety booth of claim 2 further comprising third relay means, said second solenoid means comprising contact means connected to energize said third relay means and said time delay means, outside communication lines, communication means in said booth, said first and second relay means having first and second contacts respectively connected in series between said communication lines and said communication means.

9. The alarm and safety booth of claim 8, wherein said third relay means has third contacts, further comprising local alarm means on said booth, said third contacts being connected to energize said local alarm means.

10. The alarm and safety booth of claim 1, wherein said booth has a removable top, said control circuit being located in said removable top.

* * * * *